United States Patent [19]

Meadows et al.

[11] 4,158,246

[45] Jun. 19, 1979

[54] PORTABLE CORDLESS SCRUBBER

[75] Inventors: Robert J. Meadows; Stephen D. Doolittle, both of Danville, Va.

[73] Assignee: Disston, Inc., Greensboro, N.C.

[21] Appl. No.: 831,246

[22] Filed: Sep. 7, 1977

[51] Int. Cl.[2] ..... A46B 13/02

[52] U.S. Cl. ..... 15/28; 51/170 T; 310/50

[58] Field of Search ..... 15/28, 29, 49 R, 50 R, 15/97 R; 51/170 T, 177; 310/50, 75 R, 114

[56] References Cited

U.S. PATENT DOCUMENTS

| | | | |
|---|---|---|---|
| 1,796,641 | 3/1931 | Zimmerman et al. | 15/29 |
| 2,552,023 | 5/1951 | Andresen | 310/50 X |
| 3,027,585 | 4/1962 | Freedman et al. | 15/97 R X |

*Primary Examiner*—Edward L. Roberts
*Attorney, Agent, or Firm*—B. B. Olive

[57] ABSTRACT

A hand-held, portable, cordless scrubber is disclosed which incorporates counter-rotating, scrubbing brushes detachably mounted on counter-rotating, concentric shafts. The scrubber housing is designed to prevent the entry of moisture and provides a pocket with a detachable cover for receiving a battery pack which can be recharged by direct plugging into an ordinary AC household receptacle. Both finger-actuated, handle-mounted switch and brush pressure actuated switch arrangements are provided. Snap-on pads, and the like, may also be employed.

16 Claims, 31 Drawing Figures

PORTABLE CORDLESS SCRUBBER

CROSS-REFERENCE TO RELATED APPLICATION

This application represents an improvement upon the subject matter of copending application Ser. No. 607,376, filed Aug. 25, 1975, entitled "Cordless Electric Devices", now U.S. Pat. No. 4,084,123.

BACKGROUND OF THE INVENTION

1. Field of the Invention

This invention relates to powered brushing, scrubbing and similar cleaning devices and particularly to hand-held, portable, cordless devices of this nature.

2. Description of the Prior Art:

It has been known in the prior art to provide battery-powered devices suitable for scrubbing, polishing, cleaning, skin treatment, and the like. U.S. Pat. Nos. 3,343,192; 3,380,093; 4,005,502 and 4,027,348 exemplify the general state of the art with respect to hand-held, portable, self-contained, cordless devices of this kind. U.S. Pat. Nos. 3,444,576 and 3,733,634 represent variations thereof.

The types of cordless devices described in the aforementioned patents are generally similar in the sense of being designed to rotate, orbit or oscillate a single pad, brush, or the like. Such singly driven brushes, pads, or the like, when rotated, tend to cause "skating" or lateral movement across the surface of the area being cleaned or polished. Specifically with regard to the problem of cleaning fabric, it has been observed in U.S. Pat. No. 1,796,641 that the provision of counter-rotating brushes, when applied to fabric being cleaned, tends to prevent wrinkling of the fabric. However, it is noted that this patent does not teach a portable, cordless-type of cleaning device with snap-fitted, counter-rotating brushes capable of providing a relatively small diameter brush operating at relatively high speed and low torque or a somewhat larger brush operating at relatively low speed and high torque or the combination of the two brushes operating at such different torques and speeds so as to meet a variety of cleaning conditions particularly as found in the ordinary household. It is also noted that the counter-rotating brush device of U.S. Pat. No. 1,796,641 does not provide a portable, cordless device with means to quickly detach the brush, set of brushes, or other devices being used for cleaning, scrubbing, polishing, or like operation. Also, the gear and drive mechanisms of such patented device require securement and introduce lubrication considerations.

Thus, it becomes the general object of this invention to overcome the foregoing shortcomings of the prior art and to provide a vastly improved, hand-held, portable, cordless device adapted to scrubbing, cleaning, polishing, and the like, particularly when fluids are being used for such purposes. It also becomes an object of the present invention to provide such a portable, cordless device with a rechargeable battery pack arrangement enabling a quick replacement of the battery power source. Also, while single shaft, snap-fitted brushes are known, an object is to provide improved snap-fit connections for counter-rotating concentric drives.

SUMMARY OF THE INVENTION

The present invention provides a hand-held, portable, cordless scrubber which can be adapted for polishing, cleaning, and similar operations. The cordless scrubber of the invention utilizes counter-rotating, detachable brushes which are driven through a self-lubricating, planetary gear-shaft system such that the outer brush operates in one direction at a relatively low speed and high torque and the inner brush operates in an opposite direction at a relatively high speed and low torque. The speeds are preferably inversely proportional to the mean diameters of the brushes to minimize the skating effect. The inner and outer brushes can be used either singly or in combination depending on the particular scrubbing or cleaning operation being undertaken. Inner and outer or single pads, and the like, can be used in a similar manner.

A clamshell-type housing is provided and is sealed with a unitary strip seal between the mating joint to prevent entry of water or other fluids. Such seal is also formed with a flexible switch cover portion. The housing also provides an outwardly opening pocket which is adapted to receive a rechargeable battery pack such as described in the copending application Ser. No. 607,376. The pocket and battery pack are enclosed by a snap-fitting splash guard cover which enables quick removal and replacement of the battery pack for recharging purposes and also protects the battery pack against entry of moisture or fluids when the scrubber is being used.

In one embodiment, the cordless scrubber of the invention is provided with a push on-push off type finger-actuated, handle-mounted switch and in another embodiment is provided, in addition to the finger-actuated, handle-mounted switch, with a brush pressure-actuated switch which can be operated in conjunction with the finger-actuated switch by providing for vertical play in the central base and for axial movement in the drive shafts.

DESCRIPTION OF THE PREFERRED EMBODIMENT

Substantial background information has been set forth in copending application Ser. No. 607,376 and to which reference may be made for a better understanding of the present invention. In application Ser. No. 607,376 there is described a family of cordless tools, each of which is designed with a standard type of outwardly opening pocket which is designed to receive a unique type of rechargeable battery pack. Such pack is designed as fully described in pending application Ser. No. 607,376, such that it can be either placed into the pocket of a particular tool and be connected to the apparatus of that tool or, for recharging, be placed in an AC household type receptacle. AC household type prongs are provided on the pack and AC household type prong receptacles are provided in the tool pocket for such purpose.

The cordless scrubber of the present invention utilizes a rechargeable battery pack with extending AC household type prongs which can be inserted either into an AC household type receptacle for recharging or directly into the pocket of the cordless scrubber of the invention to operate such scrubber. The description to follow will first summarize the most relevant aspects of the teachings of pending application Ser. No. 607,376 with respect to the rechargeable battery pack and mating pocket configuration described in such pending application. Thereafter, the description will be directed to describing those aspects of the hand-held, portable, cordless scrubber of the invention related to the counter-rotating shaft mechanism and the modified type of pocket and housing discovered to be of particular advantage for the purposes of the present invention with manual and pressure switching.

Figure 1:
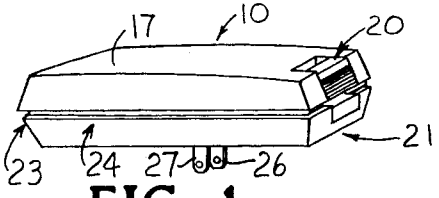
FIG. 1 is a perspective view of the battery pack employed with the cordless scrubber of the invention and shown in an inverted position.
Figure 2:
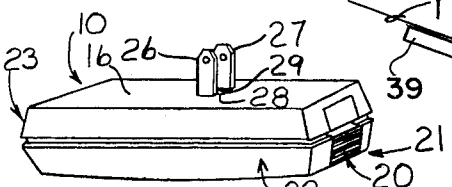
FIG. 2 is a similar view of the battery pack in an opposite position.
Figure 3:
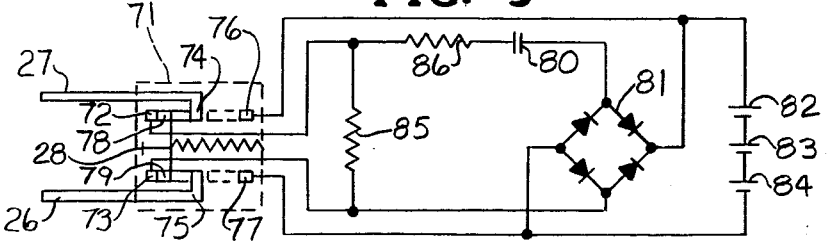
FIG. 3 is a schematic circuit diagram of the charge and discharge circuitry incorporated within the battery pack.
Figure 5:
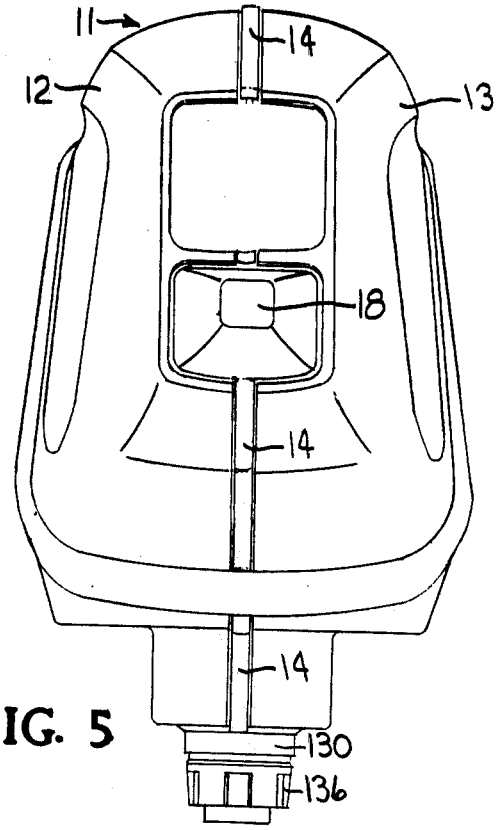
FIG. 5 is a front elevation view of the scrubber of FIG. 4 with the brushes removed.

FIGS. 1 and 2 illustrate the outward appearance of the battery pack 10 utilized with the cordless scrubber of the present invention and FIG. 3 represents an electrical circuit diagram for the battery pack 10. As best seen in FIGS. 1 and 2, battery pack 10 has a generally rectangular, flat, box-like shape, i.e. a rectangular, parallelepiped shape, and has rectangular, generally flat side wall surfaces 16 and 17 and sides 21, 22, 23, 24. The side wall surfaces 16, 17 are of greater respective area than are the respective areas associated with the sides 21–24. A pair of standard, rigidly-mounted AC blades or prongs 26, 27 extend from surface 16 and are oriented parallel to the central long axis of pack 10 with the prongs being located at a position intermediate the length and width of wall surface 16.

Located between prongs 26, 27 and recessed slightly below an aperture 29 in the pack housing is a spring-loaded switch actuator 28. Actuator 28 must be engaged by a post member to switch the pack circuitry from the charging to the discharging mode after pack 10 is installed in a manner to be described later. Side surface 21 is provided with a resilient latch member 20 which is adapted to engage a ledge portion of the tool pocket in order to latch pack 10 in place in an upwardly-angled position.

The charging and discharging circuitry of pack 10 will now be described with reference to the schematic circuit diagram of FIG. 3. A double-pole, double-throw switch 71 is adapted to place the circuitry in either a charging or discharging mode. Switch 71 includes six terminals 72, 73, 74, 75, 76, 77. AC terminals 72, 73 are connected to the charging circuitry. DC terminals 76, 77 are connected to the discharge circuitry. Common terminals 74, 75 are connected directly to the AC prongs 26, 27 and are, in the preferred embodiment, continuations of the prongs themselves. Movable contacts 78, 79 are spring-loaded in such a manner that they normally connect AC terminal 72 to terminal 74 and AC terminal 73 to terminal 75 as depicted in FIG. 3. The charging circuitry comprises (1) a capacitor 80 which is adapted to drop the input voltage; (2) a diode bridge full wave rectifier 81; (3) batteries 82, 83, 84 connected in series; (4) a bleed resistor 85 which is selected to quickly bleed by completing an RC circuit with a short time constant; and (5) a surge resistor 86 which prevents the diode bridge 81 from receiving a large surge when capacitor 80 is completely discharged. The discharge circuitry is, of course, a direct connection between AC prongs 26, 27 terminals 74, 75, and batteries 82, 83, 84.

Figure 6:
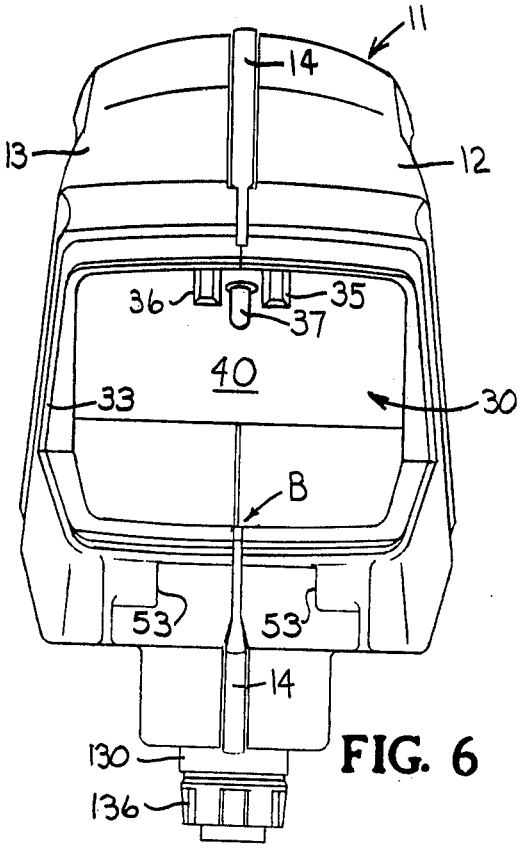
FIG. 6 is a rear elevation view of the scrubber of FIG. 4 with the brushes and power pack splash guard removed and looking into the power pack receiving pocket without the pack.
Figures 16, 25, 26, 27, 28, 30, 31:
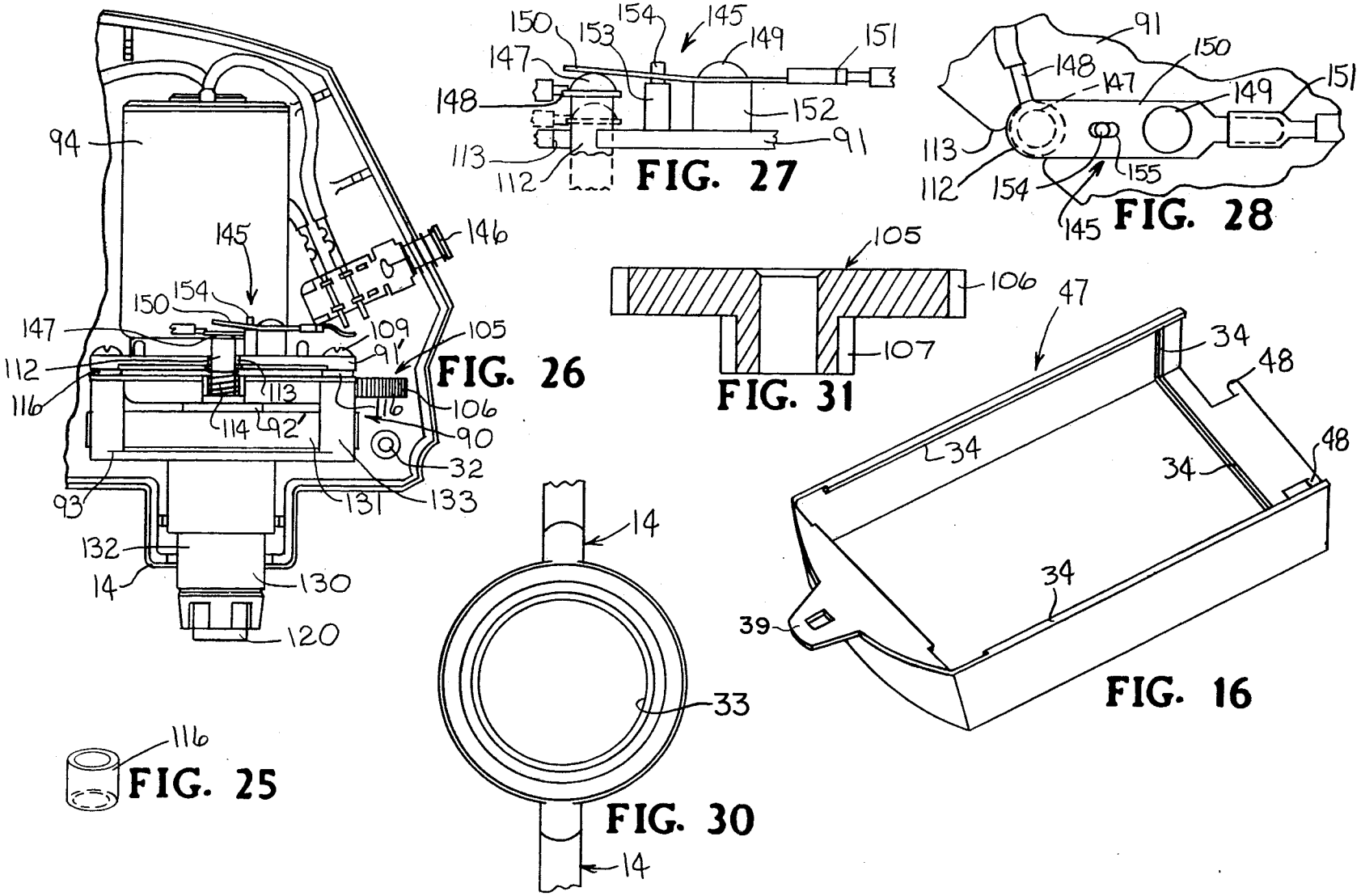
FIG. 16 is a perspective view of the battery pack snap-fit splash cover.
FIG. 25 is a perspective view of an annular spacer used with the pressure switch actuated embodiment.
FIG. 26 is an elevation view of the motor drive assembly depicted in FIG. 7 but modified to incorporate a pressure-actuated switch arrangement according to the second embodiment.
FIG. 27 is a side view of the pressure switch arrangement.
FIG. 28 is a top view of the pressure switch arrangement.
FIG. 30 is an enlarged plan view of the circular portion of the seal strip which surrounds the outer shaft to provide sealing.
FIG. 31 is an enlarged sectional view of the combination gear.

Scrubber 11 of the present invention includes a pair of clamshell housing members 12, 13 which are secured together with an intermediate, waterproofing, molded, resilient, perimeter seal 14 to form a housing having a hand grip 15 with a molded recess 25 for the fingertips. Seal 14 extends generally between points A and B (FIGS. 6–7) around the housing between housing halves 12, 13 and includes an integrally-formed, flexible switch cover 18 which provides a seal over a finger-actuated switch 146, later described. Also, a circular ring portion 23 (FIG. 30) is molded as an integral portion of seal 14 and surrounds outer shaft 130 as indicated at point C (FIG. 7) where the housing halves are joined to prevent entry of fluids in this area. Housing members 12, 13 are secured together by screws 19 which pass through openings 31 in left housing member 12 and screw into bosses 32 internal of right housing member 13. The mating edges of members 12, 13 and the cross-section of seal 14 are suitably shaped to provide the desired sealing effect, an H cross-section being preferred.

The cordless scrubber of the invention includes a battery pack receiving pocket 30 designed to receive the rechargeable battery pack 10, previously described. Pocket 30 is formed as an integral part of clamshell housing members 12, 13 in the lower, rear surface of scrubber 11 where battery pack 10 can be easily inserted for overall tool balance. The thin base wall of pocket 30 is defined by a pocket liner 40 illustrated in FIGS. 7, 8 and 9 and which can be identical to the liner disclosed in pending application, Ser. No. 607,376. In order to retain liner 40 in place, pocket 30 is provided with a plurality of liner locaters 41 which extend from the housing interior wall surfaces of pocket 30 and are adapted to engage locater grooves 42 in liner 40. A front housing wall member 43 of pocket 30 is provided with a recess 44 for receiving a projection 45 on liner 40 as a further means for locating and holding liner 40 in place. Pocket 30 is devoid of guideways, and the like, enabling pack 10 to be inserted and removed by a rocking motion and to pop out when unlatched. Liner 40 serves as a base wall in pocket 30 and includes a flat surface 50, an inclined surface 51, a lip portion 52 and an extension or projection 45 (previously mentioned). Flat surface 50 is adapted to engage the flat inner wall surface of battery pack 10 when pack 10 is inserted into pocket 30. Surfaces 51, 52 are adapted to facilitate the pivotal insertion and removal of pack 10. Surface 50 provides two AC prong-receiving, chamfered slots 35, 36. A switch actuating post 37 is integral with liner 40 and extends outward into pack receiving pocket 30. When pack 10 is inserted into pocket 30 and rocked into position, post 37 depresses switch actuator 28 to switch pack 10 circuitry from the charging to the discharging mode. Latch member 20 engages ledge portion 46 of scrubber pocket 30 in order to hold pack 10 in place in scrubber 11. Removal of pack 10 from pocket 30 is achieved by pressing latch member 20 inward so as to release member 20 from ledge portion 46 of pocket 30.

A unique feature of the invention is that of providing a protective, pivotal, snap-fitted splash cover to protect battery pack 10 when installed. For this purpose, splash cover 47 is molded of plastic as an integral unit so as to fit snugly over pack 10 when pack 10 is inserted into pocket 30 to provide protective water-proofing. Cover 47 has pins 48 molded integral therewith (FIG. 16) and which fit into recesses 49 in bosses 53 in left and right housing halves 12, 13. Pins 48 allow for pivoting of cover 47 about these pins and cover 47 is further designed to snap-fit in place about pack 10. That is, the edges 33 (FIG. 6) of pocket 30 are suitably grooved to receive somewhat resiliently molded and snap-fitting internal ridges 34 (FIG. 7) such that by utilizing the integrally-molded finger tab 39, cover 47 can be easily secured by snap-fitting, or released and pivoted by disengaging such mating surfaces. Splash cover 47, thus, provides a sealed, waterproof area for battery pack 10.

Having described the rechargeable battery pack and the unique waterproof battery pack pocket of the invention, the description will next refer to the motor and planetary gear system assembly which provides a pair of counter-rotating drive shafts to which appropriate cleaning brushes, or the like, can be secured by snap-fit connection for counter-rotation and with one shaft and its mounted brush being adapted to operate at a relatively high speed and low torque and the other shaft with its mounted brush being adapted to operate at a relatively low speed and high torque.

Figure 11:
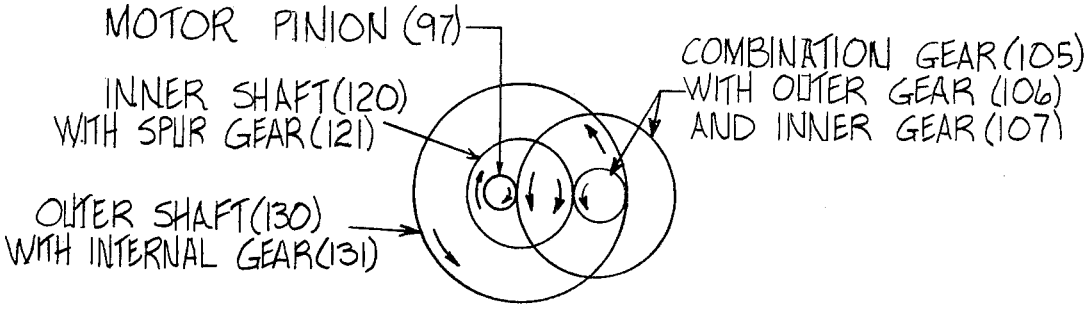
FIG. 11 is a diagram of the planetary gear system associated with the counter-rotating drive shafts.

Prior to describing the gear system in detail, reference is made to the schematic diagram of FIG. 11 from which can be seen that the gear system of the invention scrubber is actually a spur gear system with an internal gear. Referring specifically to FIG. 11 and the labeled diagram shown therein, it can be seen that the gear system includes a motor pinion, a combination gear, an inner shaft with a spur gear and an outer shaft with an internal gear. As can be best appreciated from later description, it will also be seen that the inner shaft with its spur gear is actually molded as an integral shaft-gear unit and the outer shaft with its internal gear is separately molded as an integral shaft-gear unit. Referring further to FIG. 11 specifically and looking at the gear train from above, it can be seen that the motor pinion turns in a clockwise direction. This causes the illustrated combination gear to turn counter-clockwise. Since the small or inner gear is trapped between the spur gear portion of the inner shaft and the internal gear portion of the outer shaft, the two drive shafts turn in opposite direction with different speeds and torques.

With continued reference to FIG. 11 and the labeled diagram shown therein, the fast-slow relationship of the inner and outer shafts is established by the number of teeth of their respective gears. The same gear, i.e., the motor pinion, causes both shafts to turn. Therefore, the inner shaft, preferably having 32 teeth on its gear, turns twice for each time the outer shaft, preferably having 64 teeth on its gear, turns once. Since the outer shaft turns slower than the inner shaft, it develops more torque. Therefore, a job requiring more torque might be adapted to the outer shaft while a job requiring less torque could be adapted to the inner shaft.

Figures 7, 8, 9:
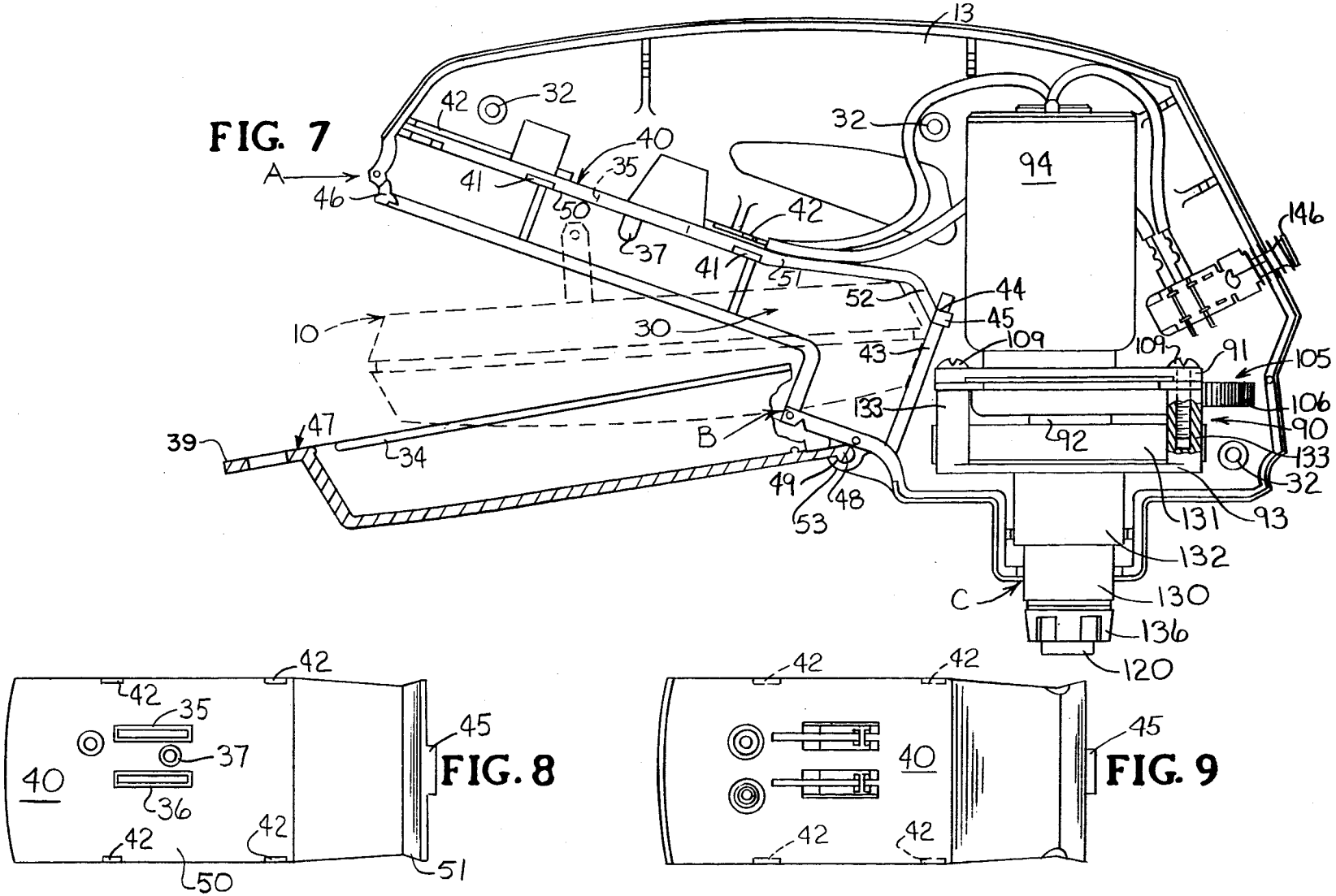
FIG. 7 is a side elevation view of the cordless scrubber of the invention with the left housing half removed, with the splash guard pivoted open, with the brushes removed and with the power pack in a released position as indicated in dashed lines.
FIG. 8 is a view of the outer surface of the liner used to form the base of the pocket which receives the battery pack.
FIG. 9 is a view of the inner surface of the liner.
Figure 10:
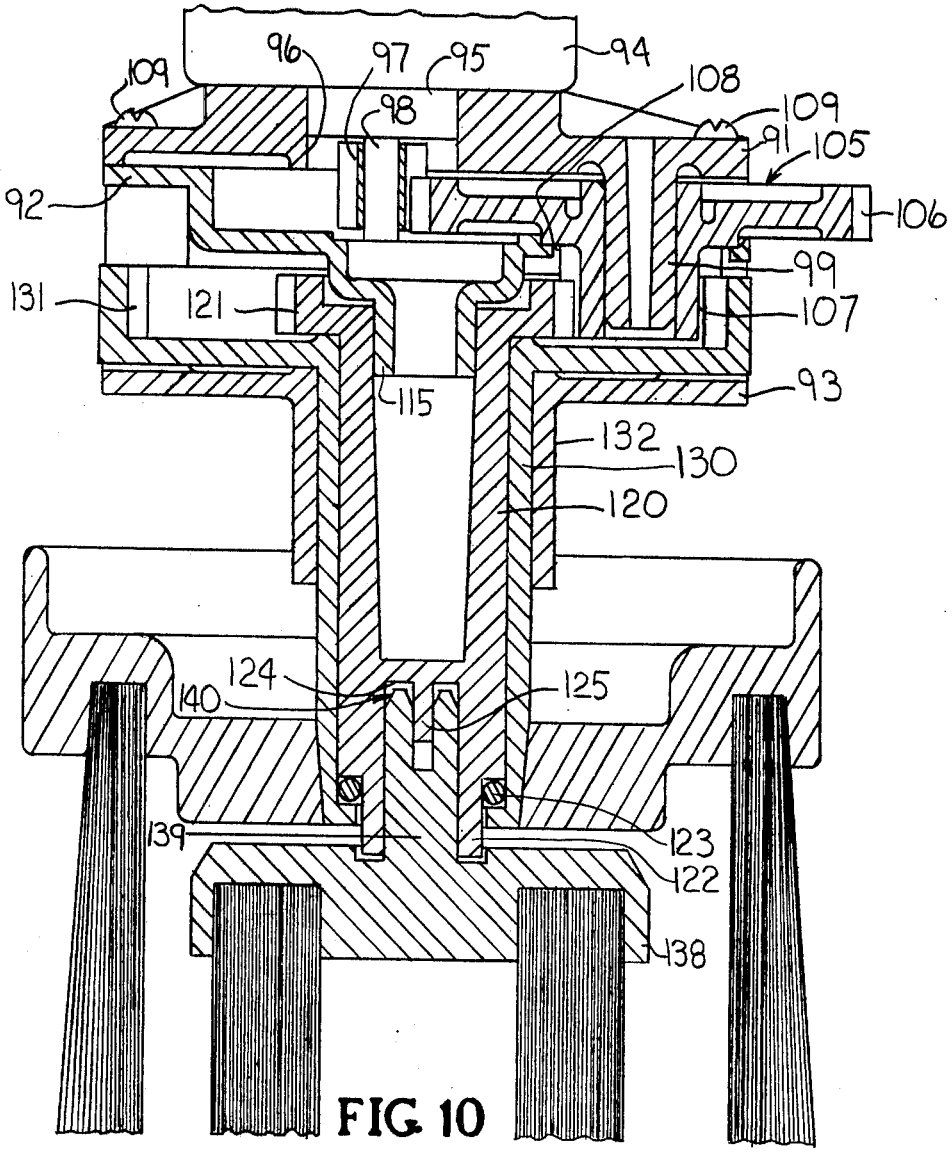
FIG. 10 is a fragmentary section view of the internal motor and counter-rotating shaft mechanism with a pair of counter-rotating brushes mounted thereon.

As seen in FIGS. 7 and 10, the gear system 90 of the invention is mounted in a gear train housing made up of a top base 91, a center base 92, and a lower base 93. Top base 91 is generally rectangular in shape and is attached to motor 94 by means of a pair of screws 89 (FIG. 21) which pass from beneath through base 91 and thread into appropriate threaded receptacles in the housing of motor 94. Top base 91 includes an opening 96 which receives a hub 95 formed integral with motor 94 and which assists in maintaining motor 94 in secure alignment on top base 91. The motor pinion gear 97 mounted on shaft 98 of motor 94 extends below top base 91 and turns in a clockwise direction as viewed from above as previously diagrammed in FIG. 11. Top base 91 also includes an integral downwardly extending post 99 which provides a fixed stub shaft on which combination gear 105 rotates. The larger diameter gear portion 106 of combination gear 105 meshes with the motor pinion 97 and is driven in a counterclockwise direction of motor pinion 97. Base 92, in this first embodiment, remains fixed.

The center base 92, like the top base 91, is molded as an integral unit and is suitably shaped and partially encloses the combination gear 105. Center base 92 includes a hole 108 through which the smaller diameter gear portion 107 of combination gear 105 extends downwardly and centrally of combination gear 105 to engage the spur gear 121 which is formed integral with the inner shaft assembly 120. Center base 92 also includes a central, integral, hollow post member 115 which extends downwardly from the underside of center base 92 and the hollow internal shaft assembly 120 with its integral spur gear 121 are rotatably mounted on post member 115. Thus, post member 115 effectively acts as a stub shaft formed integral with center base 92 for receiving and rotatably mounting one end of the hollow inner shaft assembly 120.

Figure 12:
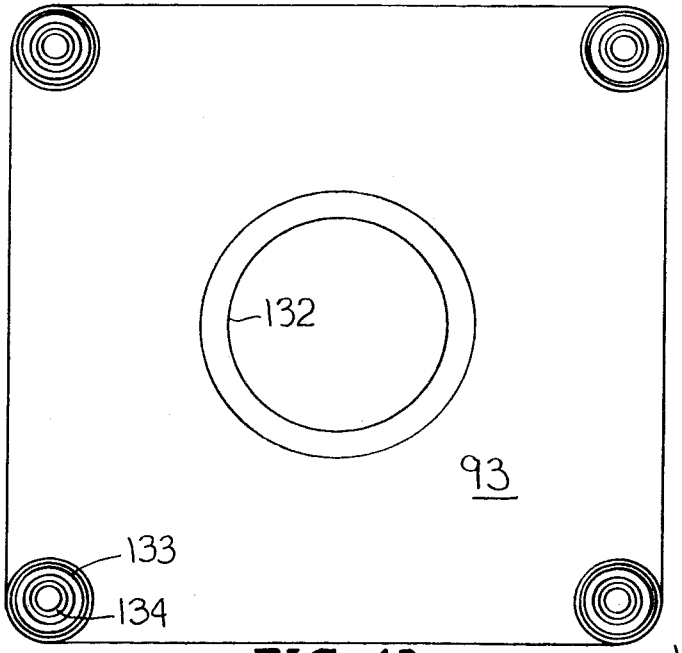
FIG. 12 is an enlarged top view of the lower base member which mounts the gear system.

The lower base 93 is also generally rectangular in shape as depicted in FIG. 12 and includes four screw-receiving studs 133 and it will be noted that center base 92 is effectively clamped between top base 91 and lower base 93 and is held secured by four screws 109 which are screwed into the respective four studs 133 to unit motor 94, top base 91, center base 92 and lower base 93 into an integral assembly held between members 12, 13.

Figure 17:
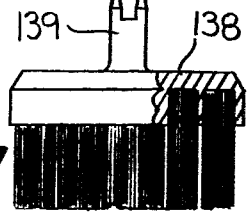
FIG. 17 is a fragmentary section view of a type of inner brush suited to employment with the scrubber of the invention.

Lower base 93 includes a downwardly extending, centrally located, hollow hub portion 132 which is adapted to receive the outer shaft member 130. Outer shaft member 130 includes the integral ring gear 131 and it will be noted that the inner shaft member or assembly 120 is slidably received within outer shaft member 130 and rotates therein. The gear portion 107 of combination gear 105 meshes with internal ring gear 131 of the outer shaft member 130 and also meshes with the outer spur gear 121 of the inner shaft member 120. Thus, the outer shaft member 131 and the inner shaft member 120 are caused to rotate in opposite directions and with the respective number of teeth previously described are caused to rotate in a manner such that the inner shaft member 120 rotates at twice the speed of the outer shaft member 130 and about the same central axis. In addition to being molded as integral assemblies with their respective driving gear and driving shaft configurations as previously described, both the inner shaft member 120 and the outer shaft member 130 are also provided with means for detachably receiving appropriate brushes, pads, or the like, for related scrubbing, cleaning, polishing, and similar operations. In this regard, the inner shaft member 120 includes a hollow end portion 124 and within such hollow end portion 124 provides a molded rib 125. Rib 125 is designed to receive an appropriate brush 138 having a post 139 adapted to mount within the hollow end portion 124 of inner shaft member 120 and with a pair of flexible ribs 140 adapted to engage rib 125 of inner shaft member 120 in a snap-fit relation. While a cleaning brush is depicted in FIG. 17, it will, of course, be appreciated by those skilled in the art that other types of cleaning pads, brushes, or the like, could be formed with a snap-fit configuration such as depicted in FIG. 17 for engaging the rib 125 and for being driven by the inner shaft member 120.

Figure 19:
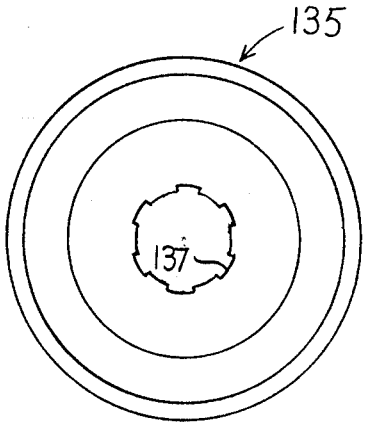
FIG. 19 is a top view of the outer brush of FIG. 18.
Figure 18:
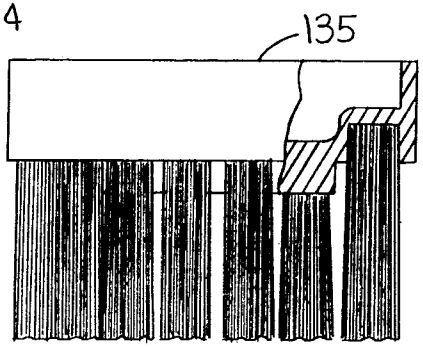
FIG. 18 is a fragmentary section view of an outer brush suited to employment with the scrubber of the invention.

The outer shaft member 130 is also adapted for receiving in a snap-fit relation appropriate brushes, pads, or the like, and for being driven in an opposite direction and at a lower speed in comparison with a brush, or the like, mounted on the inner shaft member 120. For this purpose, the outer shaft member 130 includes a plurality of splines 136 which are adapted to be received in appropriate grooves 137 in the outer brush 135 as depicted in FIGS. 18 and 19. Splines 136 are appropriately tapered and the base portion of outer brush 135 is appropriately molded such that grooves 137 will exhibit a degree of resiliency and a releasable clamping effect which can be readily obtained by molding techniques well understood in the art.

It will, of course, be understood that inner and outer brushes can be used together as illustrated in FIG. 10 or either an inner brush or an outer brush can be mounted, driven and used separately depending on the particular application. For example, a sanding abrader pad can be attached to the outer low speed shaft for high torque operation while a buffing pad can be attached to the inner high speed shaft for higher speed operation. It is contemplated by the invention that a family of such devices will be provided for interchangeable snap-fit securement to the respective inner and outer shafts for particular cleaning, polishing, abrading, scrubbing, and like applications. In all such applications, additional waterproofing protection for the drive mechanism is provided by a sealing ring 123 mounted between the outer shaft member 130 and inner shaft member 120 at the respective lower ends thereof as best seen in FIG. 10.

Figure 20:
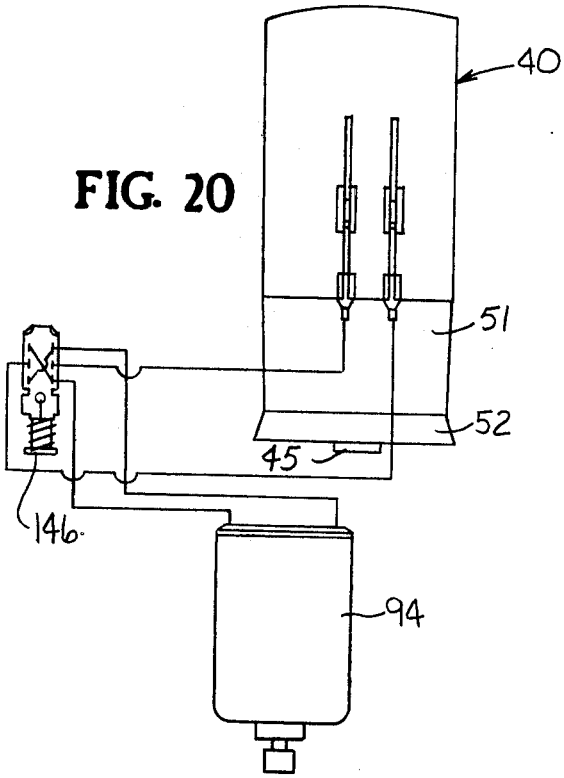
FIG. 20 is a wiring diagram of one electrical circuit appropriate to the scrubber configuration depicted in FIG. 7.

In operation, the battery pack 10 will be installed, the splash cover 47 will be snap-fitted in place to provide waterproof protection for battery pack 10 and the device can then be actuated by means of the push button switch 146 by pressing on the flexible seal cover 18, previously described. While various circuit arrangements can be employed, a typical circuit configuration is illustrated in FIG. 20 for the first manual switch embodiment.

Figure 4:
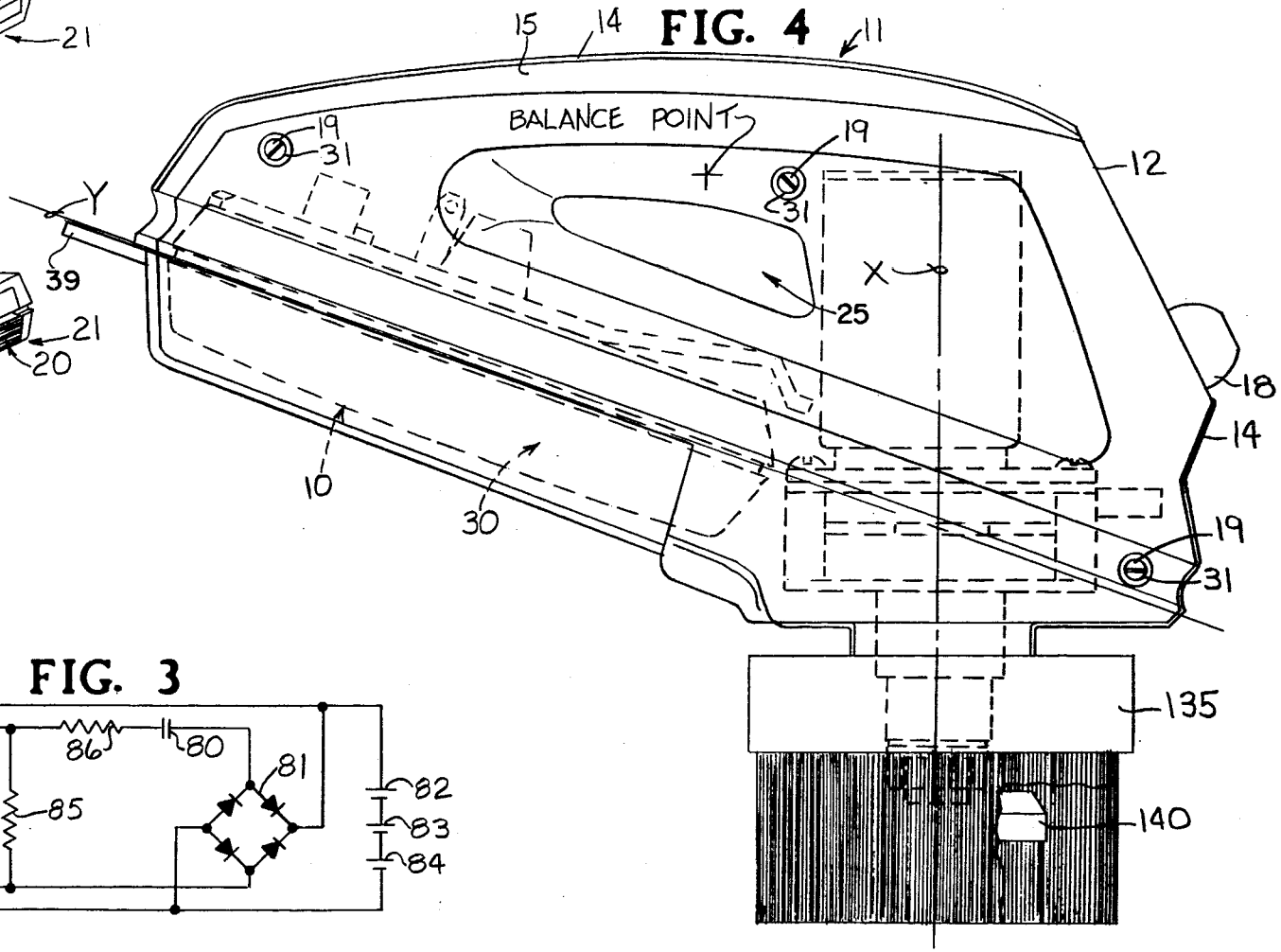
FIG. 4 is a side elevation view of the portable, cordless scrubber of the invention with the power pack inserted as indicated in dashed lines, the splash guard snap-fitted in place and a pair of detachable brushes snap-fitted for use.

Since the product of the invention is intended primarily for use in the household for a variety of applications, it will be noted that the device of the invention offers a unique arrangement in the manner in which the various components are distributed. In this regard, it will be noted that the weight of the motor 94 bears directly on the surface being brushed; thus, the householder is required to exert less downward force against the surface being treated, whether being scrubbed, cleaned, abraded, or the like. Also, to be noted is the fact that the battery pack which also represents a major weight component assumes an upwardly tilted relation in its installed position, thus, providing a comfortable balance point at the approximate position depicted in FIG. 4 in reference to brush axis X and pack axis Y.

In the embodiment previously described, control of the device is exercised solely through actuation of the mentioned on/off switch 146. In an alternative embodiment, a unique pressure-actuated switch arrangement is provided. In this embodiment, provision is made for axial movement of both the inner shaft member 120 as well as the outer shaft member 130 with respect to modified forms of the top base and center base identified as top base 91' and center base 92'. In addition to provision being made for axial movement of the respective inner and outer shaft members 120, 130, provision is also made for up and down movement of the center base 92′ which is spring loaded, in a manner later explained, to maintain a normal downward position but which can be moved upwardly whenever pressure is applied to either inner shaft member 120 or outer shaft member 130.

Figure 13:
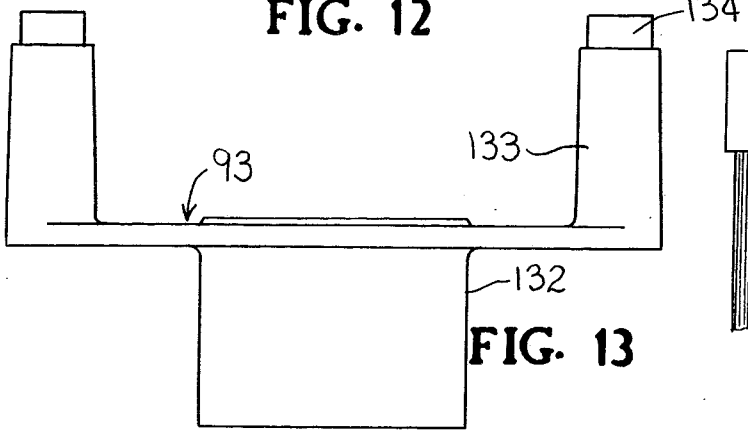
FIG. 13 is a side view of the lower base member.
Figure 22:
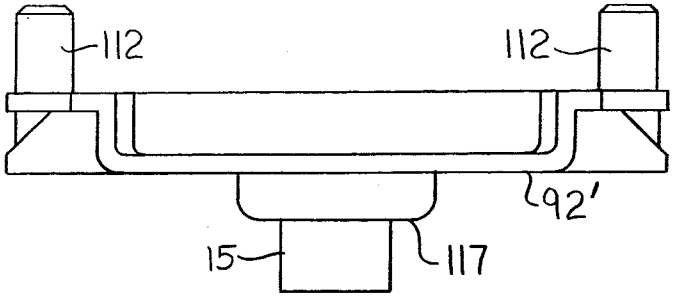
FIG. 22 is an enlarged side view of the center base member shown in FIG. 21.
Figure 21:
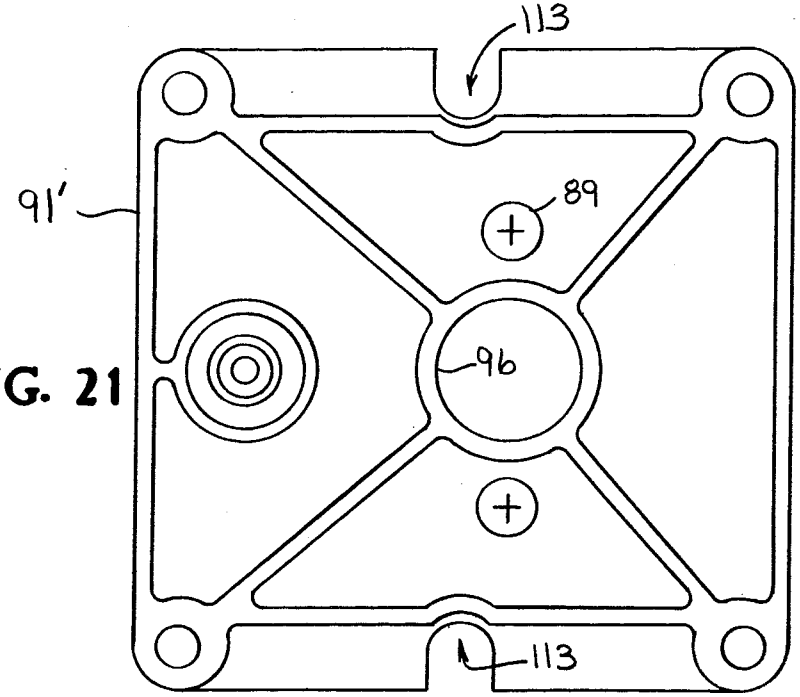
FIG. 21 is an enlarged bottom view of the center base member modified for the pressure switch embodiment.
Figure 23:
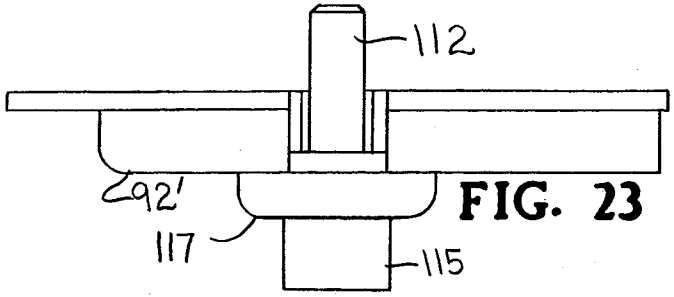
FIG. 23 is another enlarged side view of the center base member shown in FIG. 21 but from another direction.

For purposes of the pressure switch arrangement, the modified top base 91′ provides a pair of opposed notches 113 and center base 92′ (FIGS. 22 and 23) includes a pair of post 112 which extend above base 92′ and pass through the notches 113 in top base 91′ (FIG. 21). The fastening screws 109 which secure the various housing members together pass through annular spacers 116 mounted above stud 133 of lower base 93. This arrangement allows the outer corners of the modified center base 92′ to slide on the recessed portions 134 (FIG. 13) of studs 133 and on the respective spacers 116. Lower base 93 thus can be identical for both embodiments. However, the need for spacers 116 can be eliminated in the pressure switch embodiment by extending the recessed portions 134 on studs 133 on lower base 93.

Figure 15:
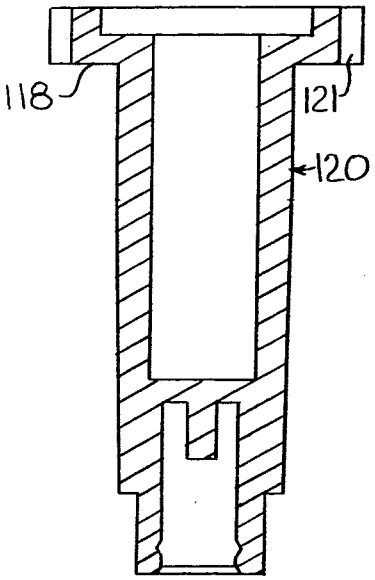
FIG. 15 is an enlarged sectional view of the inner gear-shaft member.
Figure 14:
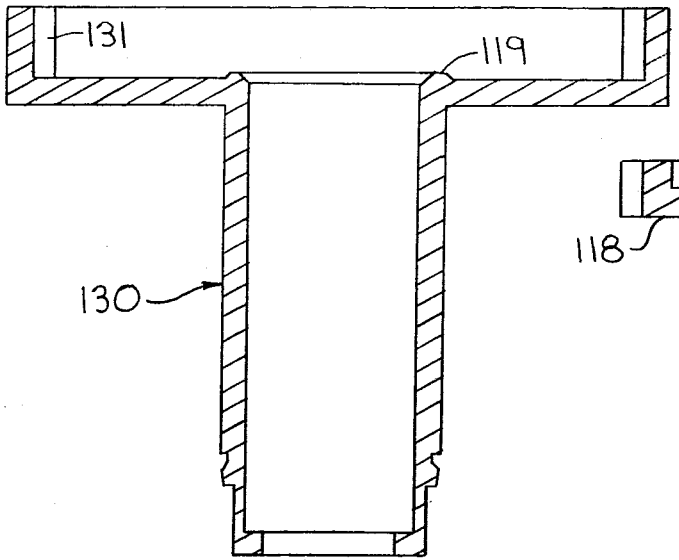
FIG. 14 is an enlarged sectional view of the outer gear-shaft member.

Before proceeding with further description directed to the pressure switch mechanism, per se, it can be noted from the foregoing description that in the alternative embodiment of the invention, the modified center base 92′ is generally pushed downwardly by the respective springs 114 but can be moved upwardly by means of pressure asserted against the surface 117 (FIG. 22) caused by upward actual motion of either the inner shaft member 120 which engages surface 117 directly as indicated in FIG. 10 or by upward axial movement of outer shaft member 130 on the bottom surface 118 (FIG. 15) of inner shaft member 120 which bears upon the surface 119 (FIG. 14) of outer shaft member 130.

Figure 24:
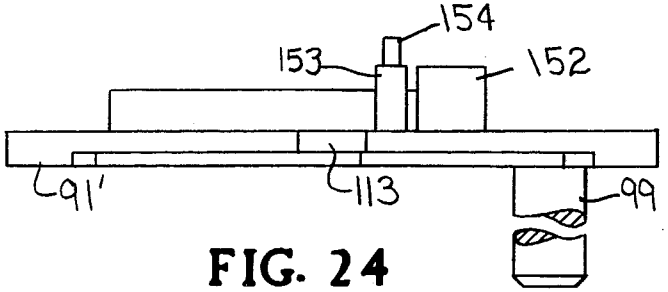
FIG. 24 is an enlarged side view of the top base member modified for the pressure switch actuation embodiment.

The upper base member 91′ (FIG. 24) represents a further modification of the previously-described base member 91 with respect to having a switch-mounting post 152 and a pivot post 153, both of which are molded as an integral part of top base 91′. One side of the pressure-actuated contact switch 145 comprises a ring tongue receptacle connector 148 which is secured to one of the posts 112 by rivet 147. This means of securement allows ring tongue 148 to move up and down with motion of the corresponding post 112 used to provide switch actuation. Support post 152 receives a contact leaf spring 150 which is secured to post 152 by rivet 149 and about which spring 150 can flex. Connection to leaf spring 150 is made through an appropriate connector 151. Pivot post 153 is located approximately midway between post 112 and post 152 and has a reduced portion 154 which passes through a slot or opening 155 and leaf spring 150. Post 153 thus guides and limits the travel of leaf spring 150.

As post 112 is moved upward by the upward movement of either inner shaft member 120 or outer shaft member 130 or both, it will be seen that the rivet 147 and connector 148 complete the necessary circuit to actuate switch 145. Correspondingly, release of the upward pressure on either inner shaft 120 or outer shaft 130 will allow the post 112 on which rivet 147 is mounted to return to its lowest position and thereby break contact between rivet 147 and leaf spring 150.

Figure 29:
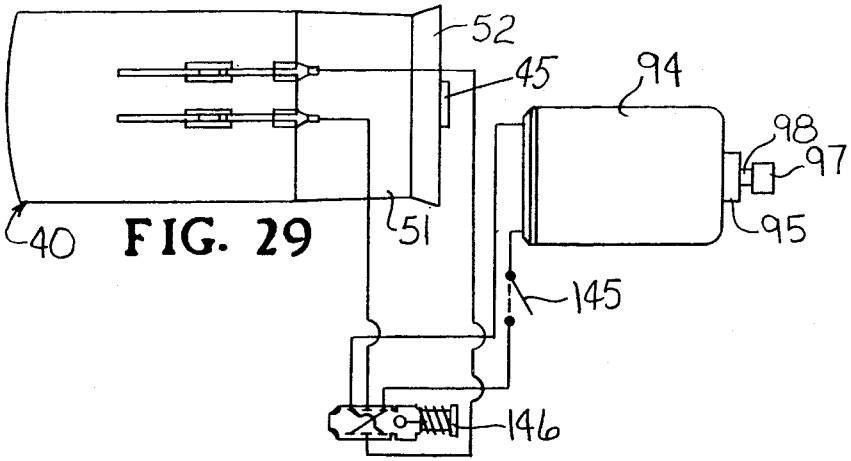
FIG. 29 is a wiring diagram illustrating an electrical circuit suited to the pressure switch configuration illustrated in FIG. 16.

It will be apparent that the finger-actuated switch 146 and pressure-actuated switch 145 can be connected together in various configurations so as to be interdependent or such that the scrubber 11 of the invention can be operated by operation of either switch. FIG. 29 represents one variation of wiring which can be adopted and which is representative of the type of circuit requiring both switches to be actuated in order to operate the scrubber 11 of the invention.

In summary, it can be seen that the invention provides an extremely versatile, cordless, portable, household tool suited to scrubbing, polishing, abrading, and like operations, typically encountered in the household. Of particular advantage is the availability of two counter-rotating inner and outer shafts adapted for snap-fit connection to corresponding inner and outer brushes, and the like. Also, of advantage is the choice of being able to operate a brush by snap-fit connection to the inner shaft at relatively high speed and low torque or by snap-fit connection a larger brush on the outer shaft operating at relatively low speed and high torque. Thus, the particular type of brush, pad, or the like, can be suited to the particular operation and equally important the operating conditions can be selected according to the job in hand. There is also provided a unique arrangement of the pack and motor-gear system within the housing which greatly reduces the amount of effort required to operate the scrubber. Since a tool of the kind afforded by the invention has unique application to various areas of high moisture condition such as scrubbing bathtubs, kitchen receptacles, and the like, it will also be seen that the various sealing arrangements of the construction of the invention afford a unique, waterproof protection, both for the battery pack as well as for the operating components of the scrubber.

It should be noted that seal 14 is a unitary sealing strip and during production assembly and later use not only provides a strip seal for the housing joint but also provides a flexible sealing cap for the push on-push off switch 146 as well as a circular seal around the lower part of outer shaft 130 where it exits the housing (point C, FIG. 7). While a flexible switch cap as such has been disclosed in U.S. Pat. No. 3,380,093, the prior art has not taught such a unique multi-purpose unitary sealing arrangement as embodied in seal 14 of the present invention. Of additional unique value to the present invention are the various interengaging snap-fitted sealing surfaces on the unitary pivotal splash cover 47 and the mating portions of the scrubber housing. Thus, when cover 47 is installed, the pack 10 is not only generally protected but is effectively sealed against entry of moisture. Yet, splash cover 47 can be easily unsnapped whenever pack 10 requires recharging.

With the described gear-shaft arrangement, it has been found possible to design a scrubber with essentially no tendency to skate and which requires minimal effort to operate. In one embodiment, the inner brush had a mean diameter of approximately 1 inch and the outer brush had a mean diameter of 2 inches and the inner brush speed was 700 rpm and the outer brush speed was 350 rpm. That is, the brushes were rotated in opposite directions at speeds inversely proportional to the mean diameters of the brushes used. Typical bristle-type brushes were employed in the illustrated configurations with excellent results.

The lubrication problem has also been essentially eliminated. In this regard, the various housing members (91 or 91′, 92 or 92′, 93), combination gear 105, inner shaft assembly 120 and outer shaft assembly 130 are preferably molded of a tough, wear resistant, acetal thermoplastic material and selected bearing surfaces, preferably those of the inner shaft 120 and lower base 93, are impregnated with high lubricity "Teflon", or the like, which minimizes friction and gives the gear-shaft system a self-lubricating characteristic.

Also to be noted is the fact that the modified top base 91' and center base 92' can be used without the spacers 116, without utilizing posts 112 or springs 114, and without the switch mechanism 145. Thus, for production purposes the device of the invention is highly versatile for market demands. This is, the device can be readily produced either solely for the regular manual switch operation, for both manual and pressure switches, or, if desired, solely for pressure switch actuation in which the regular switch 146 would not be used for control.

What is claimed is:

1. A portable, battery-operated device adapted to drive rotating brushes, pads, and the like, comprising:

(a) an integral molded housing formed of secured half sections, said housing having in an upper intermediate portion thereof a molded handle grip portion, having in a forward portion thereof an internal vertical compartment for receiving a drive motor and associated gear and drive shaft subassembly and having a lower rearward pocket with an outwardly open side and peripheral side walls, a rectangular base wall located opposite said open side and rigid with said housing and forming the base of said pocket, said base wall providing receptacle openings adapted to receive a pair of AC household type prongs and with circuit means to connect such inserted prongs to said motor;

(b) a rectangular box-shaped battery pack fitting and movable within said housing pocket side walls towards and from said base wall, said pack mounting a battery, rectifier means connected to the battery for recharging the battery, a pair of AC household type prongs projecting from one flat, substantially rectangular sidewall thereof and a switch mounted within the pack, said switch having a normal position which acts to connect said battery through said rectifier means to said prongs enabling said pack to be recharged by insertion of said prongs in an AC household type receptacle supply and having a second position which said switch is adapted to assume by being engaged whenever said pack prongs are inserted into said housing receptacle openings to connect said battery to said prongs to power said motor;

(c) actuator means arranged on said pack and pocket to move said switch to its said second position when said prongs are fully inserted into said housing receptacle openings;

(d) latching means for securing said pack in said pocket when said pack is fully inserted into said housing pocket;

(e) a drive motor and associated gear and drive shaft subassembly mounted in said forward compartment, said subassembly including:

(i) a drive motor having a drive shaft and a first drive gear mounted thereon;

(ii) reducing gear means driven by said first motor drive gear and providing a second drive gear operating at a speed reduced from that of said first motor drive gear;

(iii) an integral outer gear-drive shaft member comprising a vertical hollow shaft member having an enlarged circular upper portion formed with an internal ring gear engaging and driven by said second drive gear at a selected speed in one direction and a lower drive portion adapted for being snap-fit connected to a correspondingly formed brush, pad, or the like, for being driven thereby;

(iv) an integral inner gear-drive shaft member mounted and rotatable within said outer gear-drive shaft member and comprising a vertical shaft member having an enlarged upper circular portion formed with an external outer gear and driven by said second drive gear at a selected speed in an opposite direction to that of said outer gear-drive shaft member and having a lower drive portion adapted for being snap-fit connected to a correspondingly-formed brush, pad, or the like, for being driven thereby;

(v) gear housing means secured to and below said motor and providing mounting means for said reducing gear means, said outer and inner gear drive shaft members; and (f) a positionable control switch and circuit means enabling said switch to control the connection between said pack prongs and motor when said pack is installed in said pocket.

2. A device as claimed in claim 1 wherein said lower drive portion of said inner gear-drive shaft member is hollow and includes a snap-fit securement means therein adapted for being snap-fit connected to a brush, pad, or the like, having a correspondingly-formed shaft insertable into such hollow lower drive portion to be snap-fitted to such securement means.

3. A device as claimed in claim 2 wherein said lower drive portion of said outer gear-drive shaft member includes a spline configuration adapted for being snap-fit connected to a brush, pad, or the like, having a correspondingly-formed, grooved aperture designed to be snap-fitted to said spline configuration.

4. A device as claimed in claim 1 including an integral splash cover adapted to be snap-fitted over said pocket when containing said pack, said splash cover having an outer wall, one closed and one open end wall and a pair of opposed side walls and pin means integrally formed therewith and pivotally mounted on said housing at a position below the forward end of said pack and below said open end wall, said walls and mating receiving edges of said pocket being provided with mating sealing and snap-fitting securement means designed to provide a snap-fitted, waterproofing cover over said pack when installed in said pocket.

5. A device as claimed in claim 1 wherein said outer and inner gear-drive shaft members are adapted for axial movement towards and away from said motor and with respect to fixed portions of said gear housing means and switch means connected in circuit with said motor and pack prongs when said pack is installed and actuating means for said switch means dependent on vertical upward axial movement of one of said gear-drive shaft members for closing said switch means thereby providing a pressure-actuated switching means for said device.

6. A device as claimed in claim 4 including an integral sealing strip member secured between said housing half sections and extending around said housing between the extremities of said pocket, said strip member including an integrally-formed flexible cap portion covering said control switch and providing moisture protection therefor and an annular ring portion adapted to provide moisture sealing between said outer gear-drive shaft member and surrounding edges of said half sections.

7. A device as claimed in claim 1 wherein said pocket is upwardly angled and said pack when installed resides in an upwardly angled relation and wherein said motor and its weight is directed downwardly substantially centrally of said outer and inner gear-drive shaft members such that the balance point of said device resides proximate said handle grip portion.

8. A device as claimed in claim 1 wherein said outer gear-drive shaft member speed is substantially half that of the speed of said inner gear-drive shaft member.

9. A device as claimed in claim 1 including a pair of outer and inner brushes adapted for respective snap-fit connection to said outer and inner gear-drive shaft members and wherein the respective speeds of said outer and inner gear-drive shaft members are substantially inversely proportional to the mean diameter of said brushes.

10. A device as claimed in claim 1 wherein said reducing gear means comprises an integral molded combination gear having an upper gear driven by said first drive gear and a lower gear comprising said second drive gear.

11. A device as claimed in claim 1 wherein said control switch means includes a finger-actuated control switch mounted on said housing between said half sections and forward of said handle grip portion and having flexible protective cap means thereover held by the join of said half sections.

12. A device as claimed in claim 1 wherein said gear-shaft members are arranged for axial movement and said control switch means includes switch means dependent on axial movement of one of said gear-drive shaft members for actuation thereof.

13. A device as claimed in claim 12 wherein said control switch means further includes a finger-actuated control switch mounted on said housing between said half-sections and forward of said handle grip portion and having flexible protective cap means thereover held by the join of said half sections.

14. In a portable, battery-operated device adapted to drive rotating brushes, pads, and the like, comprising:

(a) an integral molded housing formed of secured half sections having fluid sealing means at the join thereof, said housing having in an upper intermediate portion thereof a molded handle grip portion, having in a forward portion thereof an internal compartment for receiving a drive motor and associated gear and drive shaft subassembly and having a rearward pocket with an outwardly open side and peripheral side walls, a rectangular base wall located opposite said open side and rigid with said housing and forming the base of said pocket, said base wall providing receptacle openings adapted to receive a pair of AC household type prongs and with circuit means to connect such inserted prongs to said motor;

(b) a rectangular box-shaped battery pack fitting and movable within said housing pocket side walls towards and from said base wall, said pack mounting a battery, rectifier means connected to the battery for recharging the battery, a pair of AC household type prongs projecting from one flat, substantially rectangular sidewall thereof and a switch mounted within the pack, said switch having a normal position which acts to connect said battery through said rectifier means to said prongs enabling said pack to be recharged by insertion of said prongs in an AC household type receptacle supply and having a second position which said switch is adapted to assume by being engaged whenever said pack prongs are inserted into said housing receptacle openings to connect said battery to said prongs to power said motor;

(c) actuator means arranged on said pack and pocket to move said switch to its said second position when said prongs are fully inserted into said housing receptacle openings;

(d) latching means for securing said pack in said pocket when said pack is fully inserted into said housing pocket;

(e) a drive motor and associated gear and drive shaft subassembly mounted in said forward compartment, said subassembly including:

(i) a drive motor having a drive shaft and a first drive gear mounted thereon;

(ii) reducing gear means driven by said first motor drive gear and providing a second drive gear operating at a speed reduced from that of said first motor drive gear;

(iii) an integral outer gear-drive shaft member comprising a vertical hollow shaft member having an enlarged circular upper portion formed with an internal ring gear engaging and driven by said second drive gear at a selected speed in one direction and a lower drive portion adapted for being snap-fit connected to a correspondingly formed brush, pad, or the like, for being driven thereby;

(iv) an integral inner gear-drive shaft member mounted and rotatable within said outer gear-drive shaft member and comprising a vertical shaft member having an enlarged upper circular portion formed with an external outer gear and driven by said second drive gear at a selected speed in an opposite direction to that of said outer gear-drive shaft member and having a lower drive portion adapted for being snap-fit connected to a correspondingly-formed brush, pad, or the like, for being driven thereby;

(v) gear housing means secured to and below said motor and providing mounting means for said reducing gear means, said outer and inner gear drive shaft members;

(f) a positionable control switch and circuit means enabling said switch to control the connection between said pack prongs and motor when said pack is installed in said pocket; and (g) an integral splash cover adapted to be releasably fitted over said pocket when containing said pack.

15. In a device as claimed in claim 14, said splash cover having an outer wall, one closed and one open end wall and a pair of opposed side walls and pin means integrally formed therewith and pivotally mounted on said housing at a position below the forward end of said pack and below said open end wall, said walls and mating receiving edges of said pocket being provided with mating sealing and snap-fitting securement means designed to provide a snap-fitted, waterproofing cover over said pack when installed in said pocket.

16. In a device as claimed in claim 14 wherein said pocket is both lower and rearward and is upwardly angled and said pack when installed resides in an upwardly-angled relation.

* * * * *